US006125784A

United States Patent [19]

Rehel et al.

[11] Patent Number: 6,125,784

[45] Date of Patent: Oct. 3, 2000

[54] PROTECTIVE COVER FOR PERSONAL WATERCRAFT

[76] Inventors: Perry Rehel; Michael Rehel, both of 1523 Beaver Bank Road, Beaver Bank, N.S., Canada, B4G 1C4

[21] Appl. No.: 09/455,173

[22] Filed: Dec. 6, 1999

[30] Foreign Application Priority Data

Jun. 18, 1999 [CA] Canada ..... 2275512

[51] Int. Cl.[7] ..... B63B 17/02

[52] U.S. Cl. ..... 114/361; 280/414.1

[58] Field of Search ..... 114/361; 280/414.1; 296/157

[56] References Cited

U.S. PATENT DOCUMENTS

| | | | |
|---|---|---|---|
| 3,721,467 | 3/1973 | Kerr | 296/28 M |
| 4,223,414 | 9/1980 | Dickson | 114/361 |
| 4,781,392 | 11/1988 | Cooper | 280/414.1 |
| 4,934,302 | 6/1990 | Harper | 114/361 |
| 4,995,329 | 2/1991 | Kleine | 114/361 |
| 5,076,195 | 12/1991 | Heyne | 114/361 |
| 5,564,358 | 10/1996 | Newton | 114/361 |
| 5,660,137 | 8/1997 | Manley | 114/361 |

*Primary Examiner*—Jesus D. Sotelo

*Attorney, Agent, or Firm*—Jacobson, Price, Holman & Stern, PLLC

[57] ABSTRACT

A protective cover for a personal watercraft comprises a detachable and removable housing for protecting the personal watercraft, small boat or the like and, more particularly, comprises a molded reinforced fibreglass protective cover for complete concealment and secure storage of a personal watercraft, designed to conform to the shape of the watercraft to provide full closure, i.e., to cover as well as to store it in conjunction with a wheeled trailer for transporting, launching and retrieving personal watercraft. The cover comprises a watertight underside base portion surmounted by a top cover having a rear portion hingedly connected to a front portion. The rear portion of the top cover is capable of being raised and lowered to facilitate in the raised position the ingress and egress of a personal watercraft into and out of the housing. The front portion of the housing contains a lockable access hatch capable of being opened and closed to permit access to the interior of the housing. The upper surface of the base portion is configured to facilitate sliding movement of a personal watercraft into and out of the housing; and means are provided for securing the rear portion of the top cover to the base portion to house a personal watercraft in a secure and protected manner.

12 Claims, 2 Drawing Sheets

PROTECTIVE COVER FOR PERSONAL WATERCRAFT

FIELD OF THE INVENTION

This invention relates to a protective cover for a personal watercraft and, more particularly, to a molded reinforced fibreglass protective cover or housing for complete concealment and secure storage of a personal watercraft, such as a Sea-Doo®, Polaris®, Yamaha® or Arctic Cat®.

BACKGROUND OF THE INVENTION

A personal watercraft cover is a detachable and removable housing for protecting the interior and contents of a personal watercraft, small boat or the like. It is designed to conform to the shape of the watercraft to provide full closure, i.e., to cover as well as to store them in conjunction with a wheeled trailer for transporting, launching and retrieving personal watercraft. Made from a rigid molded unit, it will not whip or flap during transportation, thus eliminating problems associated with flexible covers, such as canvas, and can be locked to the trailer to thereby prevent theft of the watercraft from the trailer. During transportation the cover also protects the watercraft against road salt, roadway debris and mud spray. The cover also protects the watercraft during storage as well as while in use, from elements like rain, snow, wind and ultraviolet radiation from the sun.

Various forms of protective covers are known to be used to protect small watercraft, such as boats. For instance, U.S. Pat. No. 4,995,329 provides a general teaching of a hull top cover that may be placed over the entire length of a boat and secured either around the hull or to an associated trailer with a shock cord or the like. Such a boat cover affords reliable and secure topside protection against the elements, while isolating all interior spaces. U.S. Pat. No. 5,076,195 illustrates a form of bow cover which is maintained in position over the bow of a boat by means of shock fasteners and functions to protect against damage from road material when the boat is being trailed. Similarly, U.S. Pat. No. 3,721,467 describes a molded reinforced plastic cover for enclosing a snowmobile on a trailer, while U.S. Pat. No. 5,660,137 relates to a detachable and removable cover for protecting the interior and contents of a dingy, small fishing boat or small jet boat. U.S. Pat. No. 4,934,302 describes a boat storage and transportation apparatus offering to cover only the top part of the boat, the cover surmounting a conventional trailer used for transporting boats and the like. Finally, U.S. Pat. No. 5,564,358 teaches an over-and-under boat cover which consists of a top cover for secure positioning over the topside of a boat in combination with a cushioning bow cover extending over the forward underside of the boat to deflect and protect against roadway debris.

None of these prior developments achieves a high degree of protection and security for property contained within a boat interior, nor provides a total housing which includes the top and bottom parts, as well as a watertight underside base, which extends protection not only against the elements and against damage from road material, but also protection against theft, pilfering and vandalism.

SUMMARY OF THE INVENTION

Therefore, it is an object of the present invention to provide a protective cover for a personal watercraft which avoids the shortcomings and drawbacks of the prior art and affords a secure and complete cover for the personal watercraft.

Accordingly, the present invention provides a protective housing for a personal watercraft, the housing being adapted to accommodate a personal watercraft and comprising a watertight underside base portion surmounted by a top cover having a rear portion hingedly connected to a front portion; the rear portion of the top cover being capable of being raised and lowered to facilitate in the raised position the ingress and egress of a personal watercraft into and out of the housing; the front portion of the housing containing a lockable access hatch capable of being opened and closed to permit access to the interior of the housing; the upper surface of the base portion being configured to facilitate sliding movement of a personal watercraft into and out of the housing; and means being provided for securing the rear portion of the top cover to the base portion to house a personal watercraft in a secure and protected manner.

Thus the invention affords a protective housing for a personal watercraft, the housing formed by a watertight underside base portion, forward part and side walls all forming an integral part of the housing and a top cover. The front part of the top cover, generally sized about one third of the base, contains a front access hatch capable of being opened and closed, thereby providing access to the interior of the housing and, in particular to storage means therein for life vests, winch straps etc. and is secured in a closed position by a locking means. The front access hatch is capable of being raised and lowered, for instance, hydraulically with the help of a pair of gas struts connected between the access hatch and the front portion of the top cover. The rear portion of the top cover is about two thirds the size of the base portion, and is hingedly connected to the front portion of the top cover. The rear portion of the top cover is capable of being raised and lowered, for instance hydraulically, with the help of two pairs of gas struts, one pair connected between the side of the rear portion of the top cover and the side of the base portion and the other pair connected between the side of the rear portion and the base of the front portion of the top cover. In the raised position the ingress and egress of a personal watercraft into and out of the housing is facilitated. The upper surface of the base portion is advantageously configured to facilitate sliding movement of a personal watercraft into and out of the housing and means are provided for securing the rear portion of the upper cover to the base portion to house a personal watercraft in a secure and protected manner.

The housing is proportioned to accommodate all types and models of personal watercraft, including two-seaters, three-seaters and four-seaters, which are normally between about 120 and 131 inches in length, up to about 43.5 inches in height and up to about 41 inches in width.

The housing will normally be mounted in a fixed manner on an automobile-towed trailer for ease of transportation. In order to load or unload a personal watercraft, the trailer may be backed down a conventional launching ramp and the watercraft slid into or out of the trailer, as required. The contour of the interior upwardly facing surfaces of the base portion is preferably complementary of the underside of a personal watercraft, to facilitate the sliding of the watercraft into and out of the housing. A pair of parallel trailer bunks may be affixed to the upper surface of the base portion of similar dimensions and spacing to the bunks of a conventional personal watercraft bunk trailer. Alternatively, rollers can be mounted on or in the upper surface of the base portion, similar to the roller assembly of a roller-type trailer for personal watercraft.

By use of the protective cover of the present invention, a personal watercraft may be stored and transported in a safe and secure manner, free from the risk of damage or loss due to theft or vandalism, while protected from the effect of the elements and from damage from road material during hauling. At the same time, the craft is readily accessible to the user by unlocking and raising the rear portion of the upper cover.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
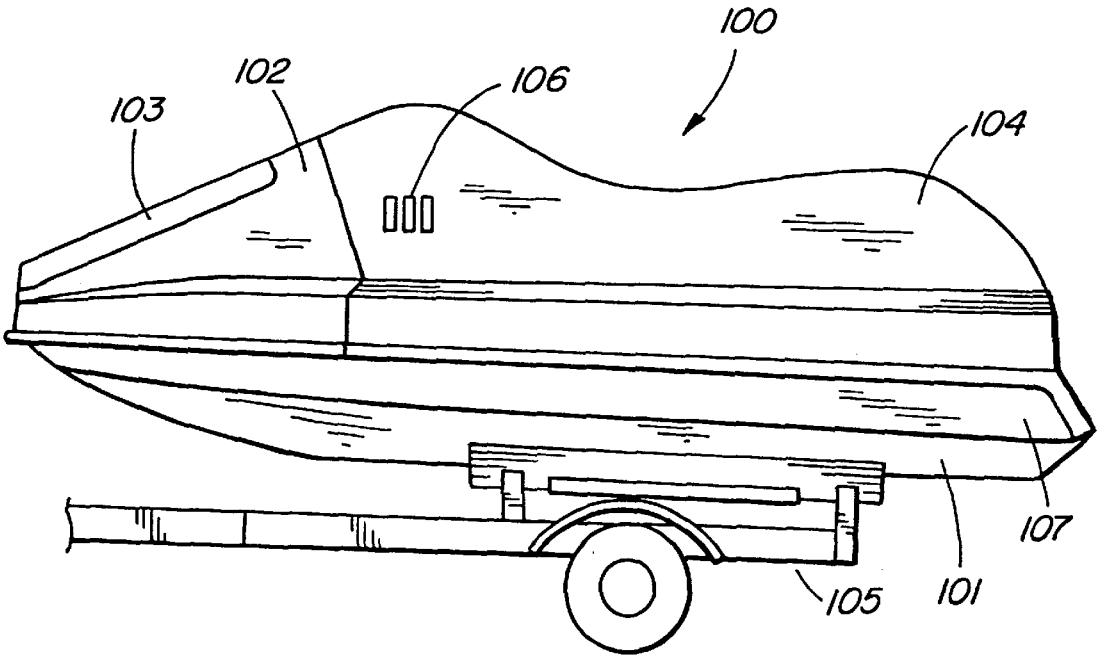
FIG. 1 is a side view of an embodiment of a protective cover for a personal watercraft with both parts of the top cover in a closed position.

FIG. 1 illustrates an embodiment of a protective housing for a personal watercraft in a closed position attached to a mobile trailer 105. The housing comprises a watertight underside base portion 101, a forward part and side walls all forming an integral part 107 of the housing, and a rigid top cover 100 constructed of a lightweight plastic material such as fibreglass. The housing is normally mounted in a fixed manner on an automobile-towed trailer 105 for ease of transportation. The top cover 100 is divided into two parts, namely a front portion 102 and the rear portion 104. The front portion 102 sized about one third of the base 101 contains a front access hatch 103, capable of being opened and closed thereby providing access to the interior of the housing. The rear portion 104 of the top cover is about two thirds in size of the base portion 101, and is hingedly connected to the front portion 102 of the top cover.

Figure 2:
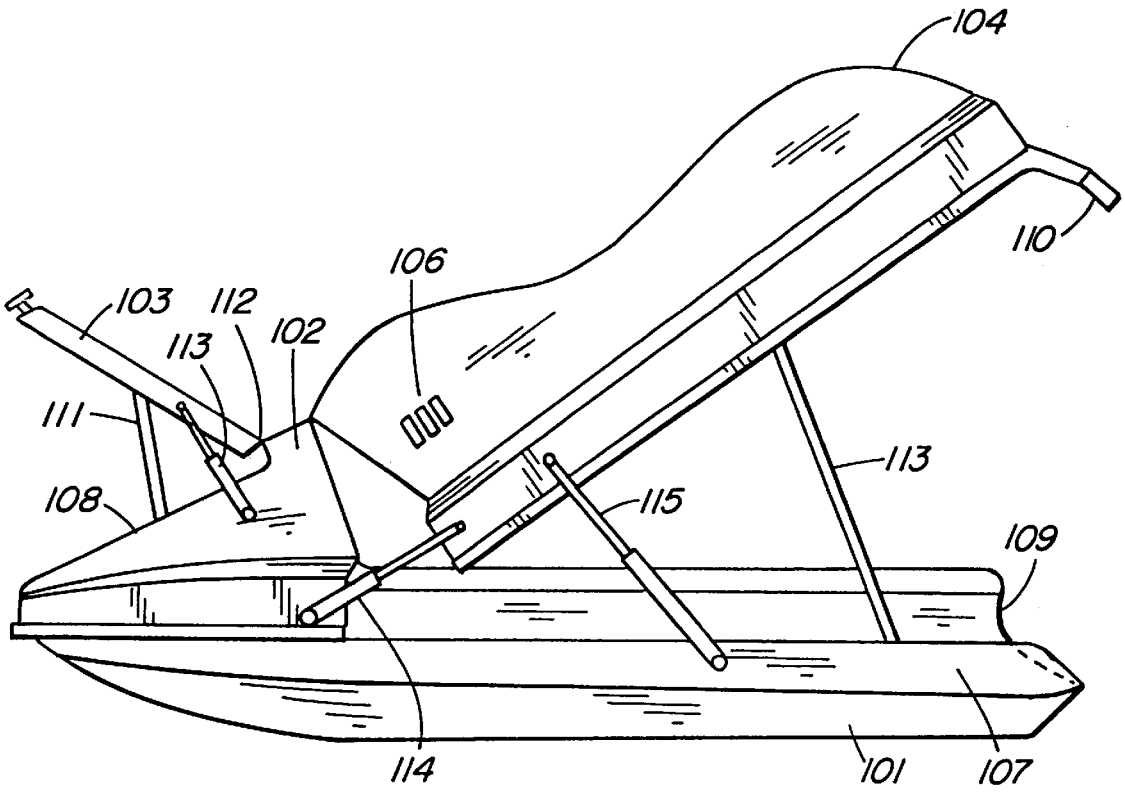
FIG. 2 is a side view of an embodiment of a protective cover for a personal watercraft with both parts of the top cover in an open position.

FIG. 2 shows the same housing in an open condition. The front access hatch 103 opens upwards providing access to a storage space 108 therein for storing life vests, winch straps and other accessories. When opened, the access hatch 103 can be made to stay in that position with the help of a pop rod 111. The access hatch 103 is hingedly connected with the front portion 102 of the top cover by means of a piano hinge 112. The rear part 109 of the underside base portion 101 is provided with a slope. The rear portion 104 of the top cover is shown in an opened position. The rear portion 104 of the top cover can be raised and lowered by means of a hydraulic system (not shown in Figure). When opened, the rear portion 104 of the top cover can be secured to stay in that position with the help of two pop rods 113.

The rear part 110 is designed in such a way so as to cover and close the slope 109 when in a closed position. The rear part 110 is provided with locking means. The shape of the rear part 109 of the underside 101 thus provides an easy ingress and egress of a personal watercraft in a secured and protected manner. The craft is readily accessible to the user by unlocking and raising the rear portion 104 of the top cover. A pair of parallel trailer bunks (not shown in Figure) may be affixed to the upper surface of the base portion 101 of similar dimensions and spacing to the bunks of a conventional personal watercraft trailer. Alternatively rollers can be mounted on or in the upper surface of the base portion 101, similar to the roller assembly of a roller-type trailer for personal watercrafts. The sides of the rear portion 104 of the top cover is provided with some holes or slots 106 for ventilation.

For the purpose of raising and lowering the front access 103, and the rear portion 104 of the top cover hydraulically, three pairs of gas struts 113, 114 and 115 are provided as shown in FIG. 2.

Figure 3:
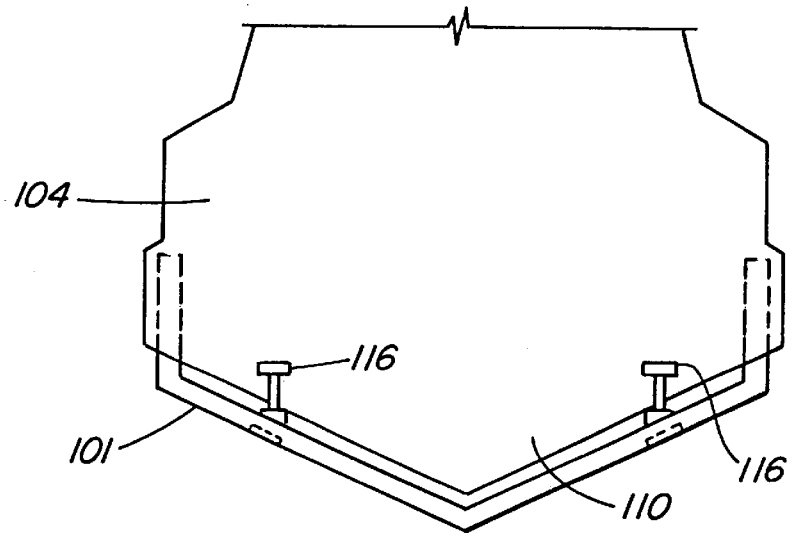
FIG. 3 is a rear view thereof with locks with the upper cover in the closed position.

FIG. 3 shows a rear view of the housing with the top upper cover 104 in the closed position. When the top cover 104 is lowered onto the base portion 101, it is secured in a closed position by a pair of locking means 116.

We claim:

1. A protective housing for a personal watercraft, the housing being adapted to accommodate a personal watercraft and comprising:

a watertight underside base portion surmounted by a top cover having a rear portion hingedly connected to a front portion;

the rear portion of the top cover being capable of being raised and lowered to facilitate in the raised position the ingress and egress of a personal watercraft into and out of the housing;

the front portion of the housing containing a lockable access hatch capable of being opened and closed to permit access to the interior of the housing;

the upper surface of the base portion being configured to facilitate sliding movement of a personal watercraft into and out of the housing;

and means being provided for securing the rear portion of the top cover to the base portion to house a personal watercraft in a secure and protected manner.

2. A protective housing for a personal watercraft according to claim 1, wherein the housing is mounted in a fixed manner on an automobile-towed trailer for ease of transportation.

3. A protective housing for a personal watercraft according to claim 1, wherein the front portion of the top cover is sized about one third of the base portion.

4. A protective housing for a personal watercraft according to claim 1, wherein the front access hatch is secured in a closed position by a locking means.

5. A protective housing for a personal watercraft according to claim 1, wherein the access hatch is capable of being raised and lowered by means of a hydraulic system comprising a pair of gas struts pivotally attached at each side of the access hatch and the front portion of the top cover.

6. A housing for a personal watercraft according to claim 1, wherein the rear portion of the top cover is about two thirds the size of the base portion.

7. A protective housing for a personal watercraft according to claim 1, wherein the rear portion of the top cover is capable of being raised and lowered by means of a hydraulic system comprising two pairs of gas struts, one pair being pivotally attached to the rear portion of the top cover and to each side of the front portion of the top cover and the other pair being pivotally attached to the rear portion of the top cover and to each side of the base portion.

8. A protective housing for a personal watercraft according to claim 7, wherein a locking means is provided for securing the rear portion of the top cover to the base portion to house a personal watercraft in a closed position in a secure and protected manner.

9. A protective housing for a personal watercraft according to claim 1, wherein ventilation means in the form of holes or slots is provided in the surface of the rear portion of the top cover.

10. A protective housing for a personal watercraft according to claim 1, wherein the upper surface of the base portion is provided with a roller arrangement or a pair of parallel trailer bunks to facilitate a sliding movement of the personal watercraft into and out of the housing.

11. A protective housing for a personal watercraft according to claim 1, wherein the contour of the interior upwardly facing surface of the base portion is complementary to that of the underside of a personal watercraft, to facilitate the sliding of the watercraft into and out of the housing.

12. A protective housing for a personal watercraft according to claim 1, wherein the front of the base portion is provided with a slot for entry of a strap for winching the housing.

* * * * *